US009995124B2

(12) United States Patent
Moore et al.

(10) Patent No.: US 9,995,124 B2
(45) Date of Patent: Jun. 12, 2018

(54) DOWNHOLE STIMULATION TOOLS AND RELATED METHODS OF STIMULATING A PRODUCING FORMATION

(71) Applicant: Orbital ATK, Inc., Dulles, VA (US)

(72) Inventors: Steven E. Moore, Elkton, MD (US); John A. Arrell, Lincoln University, PA (US)

(73) Assignee: Orbital ATK, Inc., Plymouth, MN (US)

( * ) Notice: Subject to any disclaimer, the term of this patent is extended or adjusted under 35 U.S.C. 154(b) by 816 days.

(21) Appl. No.: 14/491,518

(22) Filed: Sep. 19, 2014

(65) Prior Publication Data

US 2016/0084055 A1 Mar. 24, 2016

(51) Int. Cl.

| | |
|---|---|
| ***E21B 43/26*** | (2006.01) |
| ***E21B 43/263*** | (2006.01) |
| ***E21B 33/124*** | (2006.01) |
| ***F42B 3/04*** | (2006.01) |

(52) U.S. Cl.

CPC ..... *E21B 43/263* (2013.01); *E21B 33/124* (2013.01); *F42B 3/04* (2013.01)

(58) Field of Classification Search

CPC .... E21B 33/124; E21B 43/263; E21B 23/065; F42B 3/04

See application file for complete search history.

(56) References Cited

U.S. PATENT DOCUMENTS

| | | | | |
|---|---|---|---|---|
| 2,921,519 | A | | 1/1960 | Martin |
| 3,090,436 | A | | 5/1963 | Briggs, Jr. |
| 3,266,575 | A | | 8/1966 | Owen |
| 3,422,760 | A | * | 1/1969 | Mohaupt ..... E21B 43/263 102/313 |
| 3,602,304 | A | | 8/1971 | Mallinger et al. |
| 3,677,010 | A | | 7/1972 | Fink et al. |
| 4,253,523 | A | * | 3/1981 | Ibsen ..... E21B 43/117 102/310 |
| 4,391,337 | A | | 7/1983 | Ford et al. |
| 4,633,951 | A | | 1/1987 | Hill et al. |
| 4,729,317 | A | | 3/1988 | Burdette et al. |
| 4,798,244 | A | | 1/1989 | Trost |
| 4,823,875 | A | | 4/1989 | Hill |
| 4,840,231 | A | | 6/1989 | Berzin |
| 5,230,287 | A | | 7/1993 | Arrell, Jr. et al. |

(Continued)

OTHER PUBLICATIONS

International Search Report, ISA/KR, International Application No. PCT/US2014/017064, Jun. 23, 2014, three (3) pages.

(Continued)

*Primary Examiner* — Robert E Fuller
*Assistant Examiner* — Christopher J Sebesta
(74) *Attorney, Agent, or Firm* — TraskBritt

(57) ABSTRACT

A downhole stimulation tool comprising an outer housing exhibiting apertures extending therethrough, opposing propellant structures within the outer housing, and at least one initiator adjacent each of the opposing propellant structures. Each of the opposing propellant structures comprise at least one higher combustion rate propellant region, and at least one lower combustion rate propellant region longitudinally adjacent the at least one higher combustion rate propellant region. Additional downhole stimulation tools and methods of stimulating a producing formation are also disclosed.

27 Claims, 5 Drawing Sheets

(56) References Cited

U.S. PATENT DOCUMENTS

| | | | | |
|---|---|---|---|---|
| 5,431,101 | A | 7/1995 | Arrell, Jr. et al. | |
| 5,626,360 | A | 5/1997 | Lauritzen et al. | |
| 6,082,450 | A | 7/2000 | Snider et al. | |
| 6,263,283 | B1 | 7/2001 | Snider et al. | |
| 6,817,298 | B1 | 11/2004 | Zharkov et al. | |
| 7,073,589 | B2 | 7/2006 | Tiernan et al. | |
| 7,097,203 | B2 | 8/2006 | Burns et al. | |
| 7,353,866 | B2 | 4/2008 | Snider et al. | |
| 7,431,075 | B2 * | 10/2008 | Brooks | E21B 43/263 102/275.5 |
| 7,487,827 | B2 | 2/2009 | Tiernan | |
| 7,565,930 | B2 | 7/2009 | Seekford | |
| 7,789,153 | B2 | 9/2010 | Prinz et al. | |
| 7,810,569 | B2 | 10/2010 | Hill et al. | |
| 7,861,785 | B2 | 1/2011 | Frazier et al. | |
| 7,909,096 | B2 | 3/2011 | Clark et al. | |
| 7,950,457 | B2 | 5/2011 | Seekford | |
| 8,033,333 | B2 | 10/2011 | Frazier et al. | |
| 8,186,425 | B2 | 5/2012 | Smart et al. | |
| 8,186,435 | B2 | 5/2012 | Seekford | |
| 2003/0155112 | A1 | 8/2003 | Tiernan et al. | |
| 2005/0109509 | A1 | 5/2005 | Snider et al. | |
| 2006/0048664 | A1 | 3/2006 | Tiernan et al. | |
| 2008/0099204 | A1 * | 5/2008 | Arrell | E21B 43/1185 166/298 |
| 2008/0314591 | A1 | 12/2008 | Hales et al. | |
| 2009/0078427 | A1 | 3/2009 | Patel | |
| 2009/0159285 | A1 | 6/2009 | Goodman | |
| 2009/0301721 | A1 * | 12/2009 | Barykin | E21B 43/003 166/299 |
| 2012/0138302 | A1 * | 6/2012 | Stehle | E21B 43/11 166/297 |
| 2012/0150515 | A1 | 6/2012 | Hariharan et al. | |
| 2014/0238678 | A1 | 8/2014 | Arrell, Jr. et al. | |
| 2015/0267501 | A1 | 9/2015 | Al-gouhi | |
| 2015/0275643 | A1 * | 10/2015 | Holder | E21B 43/263 166/63 |

OTHER PUBLICATIONS

Written Opinion of the International Searching Authority, ISA/KR, International Application No. PCT/US2014/017064, Jun. 23, 2014, 12 pages.

Schatz, John, "PulsFrac™ Summary Technical Description," John F. Schatz Research & Consulting, Inc., Del Mar, CA, (2003), pp. 1-8.

Thakre et al., "Solid Propellants," Rocket Propulsion, vol. 2, Encyclopedia of Aerospace Engineering, John Wiley & Sons, LTD., (2010), pp. 1-10.

* cited by examiner

DOWNHOLE STIMULATION TOOLS AND RELATED METHODS OF STIMULATING A PRODUCING FORMATION

CROSS-REFERENCE TO RELATED APPLICATION APPLICATIONS

The subject matter of this application is related to the subject matter of U.S. patent application Ser. No. 14/491,246, filed Sep. 19, 2014, and titled "METHODS AND APPARATUS FOR DOWNHOLE PROPELLANT-BASED STIMULATION WITH WELLBORE PRESSURE CONTAINMENT, the disclosure of which is hereby incorporated herein in its entirety by this reference. This application is also related to U.S. patent application Ser. No. 13/781,217 by the inventors herein, filed Feb. 28, 2013, now U.S. Pat. No. 9,447,672, issued Sep. 20, 2016, the disclosure of which is hereby incorporated herein in its entirety by this reference.

TECHNICAL FIELD

Embodiments of the disclosure relate generally to the use of propellants for downhole applications. More particularly, embodiments of the disclosure relate to propellant-based apparatuses for stimulating a producing formation intersected by a wellbore, and to related methods of stimulating a producing formation.

BACKGROUND

Conventional propellant-based downhole stimulation tools typically employ a right circular cylinder of a single type of propellant, which may comprise a single volume or a plurality of propellant "sticks" in an outer housing. Upon deploying such a downhole stimulation tool into a wellbore adjacent a producing formation, a detonation cord extending through an axially-extending hole in the propellant grain is typically initiated and high pressure gases generated from the combusting propellant grain exit the outer housing at select locations, entering the producing formation. The high pressure gases may be employed to fracture the producing formation, to perforate the producing formation (e.g., when spatially directed through apertures in the housing against the wellbore wall), and/or to clean existing fractures formed in the producing formation by other techniques, any of the foregoing increasing the effective surface area of the producing formation available for production of hydrocarbons.

U.S. Pat. Nos. 7,565,930, 7,950,457 and 8,186,435 to Seekford, the disclosure of each of which is hereby incorporated herein in its entirety by this reference, propose a technique to alter an initial surface area for propellant burning, but this technique cannot provide a full regime of potentially available ballistics for propellant-induced stimulation in a downhole environment. It would be desirable to provide enhanced control of not only the initial surface area (which alters the initial rise rate of the gas pulse, or dP/dt, responsive to propellant ignition), but also the duration and shape of the remainder of the pressure pulse introduced by the burning propellant.

U.S. patent application Ser. No. 13/781,217 by the inventors herein, filed Feb. 28, 2013, now U.S. Pat. No. 9,447,672, issued Sep. 20, 2016, and assigned to the Assignee of the present disclosure, addresses many of the issues noted above and left untouched by Seekford.

Unfortunately, the configurations of conventional propellant-based downhole stimulation tools offer limited to no means of controllably varying the pressure within a producing formation over an extended period of time (e.g., a period of time greater than or equal to about 1 second, such as greater than or equal to about 5 seconds, greater than or equal to about 10 seconds, greater than or equal to about 20 seconds, or greater than or equal to about 60 seconds).

It would, therefore, be desirable to have new downhole stimulation tools and methods of stimulating a producing formation, which facilitate controllably varying the pressure within the producing formation over an extended period of time. In addition, it would be desirable if the downhole stimulation tools and components thereof were easy to fabricate and assemble, exhibited nominal movement within a wellbore during use and operation, and were at least partially reusable.

BRIEF SUMMARY

In some embodiments, a downhole stimulation tool comprises an outer housing exhibiting apertures extending therethrough, opposing propellant structures within the outer housing, and at least one initiator adjacent each of the opposing propellant structures. Each of the opposing propellant structures comprise at least one higher combustion rate propellant region, and at least one lower combustion rate propellant region adjacent the at least one higher combustion rate propellant region.

In additional embodiments, a downhole stimulation tool comprises an outer housing exhibiting apertures extending therethrough, a propellant structure within the outer housing, another propellant structure opposing the first propellant structure within the outer housing, and initiators adjacent each of the propellant structure and the another propellant structure. The propellant structure comprises at least one higher combustion rate propellant region, and at least one lower combustion rate propellant region adjacent the at least one higher combustion rate region. The another propellant structure comprises at least one other higher combustion rate propellant region, and at least one other lower combustion rate propellant region adjacent the at least one other higher combustion rate propellant region.

In further embodiments, a method of stimulating a producing formation comprises positioning a downhole stimulation tool within a wellbore intersecting the producing formation, the downhole stimulation tool comprising an outer housing exhibiting apertures extending therethrough, opposing propellant structures within the outer housing, and at least one initiator adjacent each of the opposing propellant structures. Each of the opposing propellant structures comprises at least one higher combustion rate propellant region, and at least one higher lower combustion rate propellant region adjacent the at least one higher combustion rate propellant region. The opposing propellant structures are each initiated to combust the opposing propellant structures and vent produced combustion gases through the apertures in the outer housing to increase pressure adjacent to and within the producing formation.

DETAILED DESCRIPTION

Figure 1:
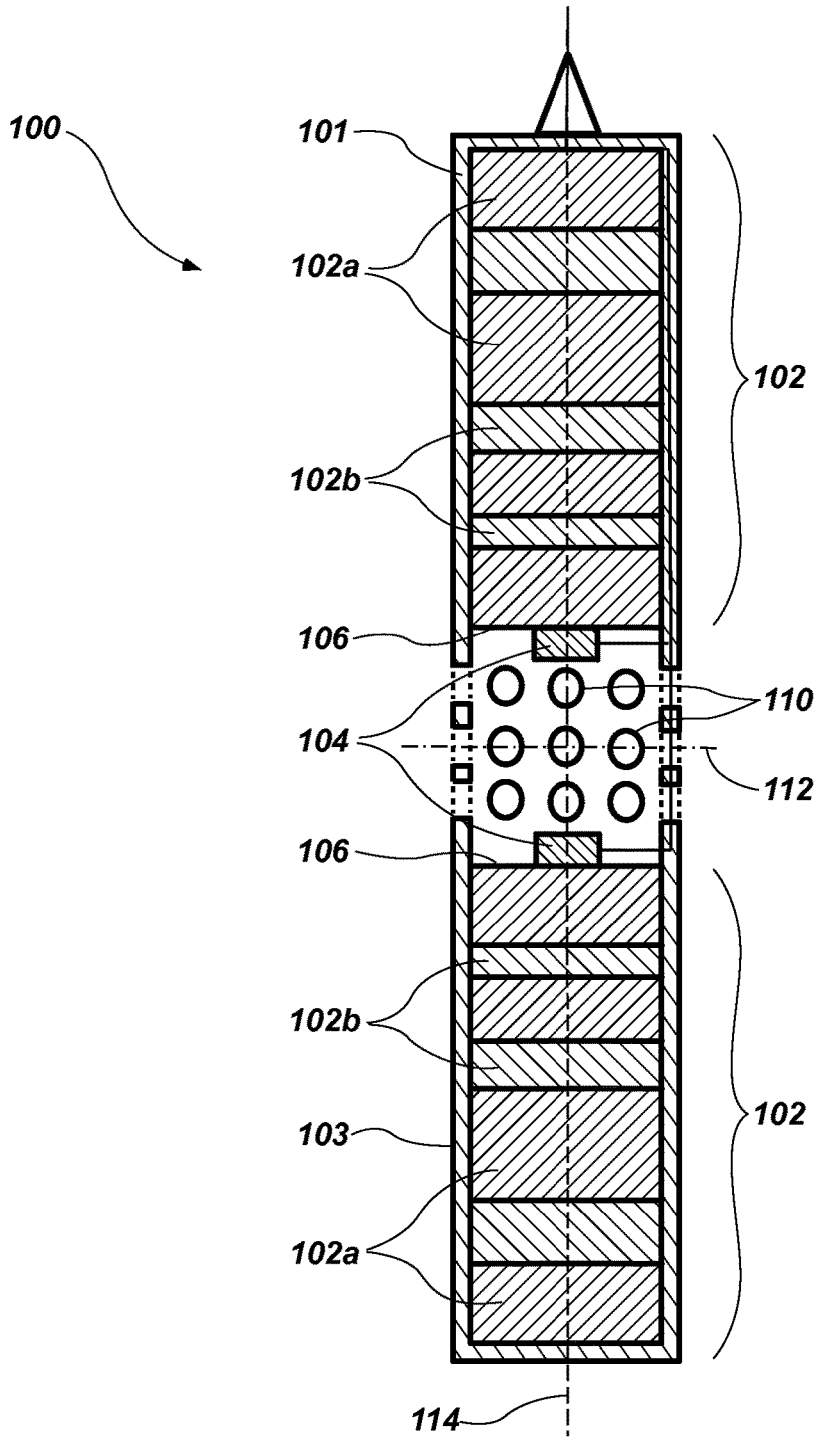
FIG. 1 is a longitudinal, cross-sectional view of a downhole stimulation tool, in accordance with embodiments of the disclosure.

Downhole stimulation tools are disclosed, as are methods of stimulating producing formations. As used herein, the term "producing formation" means and includes, without limitation, any subterranean formation having the potential for producing hydrocarbons in the form of oil, natural gas, or both, as well as any subterranean formation suitable for use in geothermal heating, cooling and power generation. In some embodiments, a downhole stimulation tool may be formed of and include an outer housing exhibiting apertures extending circumferentially through a wall thereof, opposing propellant structures within the outer housing flanking the apertures, and at least one initiator adjacent each of the opposing propellant structures. Each of the opposing propellant structures may be formed of and include at least one relatively higher combustion rate region and at least one relatively lower combustion rate region adjacent the at least one relatively higher combustion rate region. The downhole stimulation tools and methods of the disclosure may provide increased control of a pressure profile to be applied within the producing formation proximate the downhole stimulation tools over an extended period of time relative to conventional downhole stimulation tools and methods, facilating the simple, cost-effective, and enhanced stimulation of a producing formation as compared to conventional downhole stimulation tools and methods.

The following description provides specific details, such as material types, material dimensions, and processing conditions in order to provide a thorough description of embodiments of the disclosure. However, a person of ordinary skill in the art would understand that the embodiments of the disclosure may be practiced without employing these specific details. Indeed, the embodiments of the disclosure may be practiced in conjunction with conventional techniques employed in the industry. Only those process acts and structures necessary to understand the embodiments of the disclosure are described in detail below. Additional acts to form a downhole stimulation tool of the disclosure may be performed by conventional techniques, which are not described in detail herein. Also, the drawings accompanying the application are for illustrative purposes only, and are thus not drawn to scale. Additionally, elements common between figures may retain the same numerical designation.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the term "configured" refers to a size, shape, material composition, and arrangement of one or more of at least one structure and at least one apparatus facilitating operation of one or more of the structure and the apparatus in a pre-determined way.

As used herein, the singular forms "a," "an," and "the" are intended to include the plural forms as well, unless the context clearly indicates otherwise.

As used herein, "and/or" includes any and all combinations of one or more of the associated listed items.

As used herein, relational terms, such as "first," "second," "over," "top," "bottom," "underlying," etc., are used for clarity and convenience in understanding the disclosure and accompanying drawings and does not connote or depend on any specific preference, orientation, or order, except where the context clearly indicates otherwise.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

FIG. 1 is a longitudinal, cross-sectional view of a downhole stimulation tool 100 for use in accordance with an embodiment of the disclosure. The downhole stimulation tool 100 may be configured and operated to stimulate (e.g., fracture, perforate, clean, etc.) a producing formation in a wellbore, as described in further detail below. As shown in FIG. 1, the downhole stimulation tool 100 may include an outer housing 101, opposing propellant structures 102, and initiators 104. The opposing propellant structures 102 and the initiators 104 may be contained within the outer housing 101.

The outer housing 101 may comprise any structure configured to contain (e.g., house, hold, etc.) the opposing propellant structures 102 and the initiators 104, and also configured to vent gases produced during combustion of the opposing propellant structures 102. For example, as shown in FIG. 1, the outer housing 101 may comprise a substantially hollow and elongated structure (e.g., a hollow tube) including at least one major surface 103 exhibiting apertures 110 (e.g., performations, holes, openings, etc.) therein. A lateral axis 112 of the outer housing 101 may be oriented perpendicular to the major surface 103 at substantially a longitudinal centerpoint thereof, and a longitudinal axis 114 may be oriented parallel to the major surface 103 at a substantially lateral centerpoint thereof. As used herein, each of the tennis "lateral" and "laterally" means and includes extending in a direction substantially perpendicular to the major surface 103 of the outer housing 101, regardless of the orientation of the major surface 103 of the outer housing 101. Conversely, as used herein, each of the terms "longitudinal" and "longitudinally" means and includes extending in a direction substantially parallel to the major surface 103 of the outer housing 101, regardless of the orientation of the major surface 103 of the outer housing 101.

The outer housing 101 may comprise a single, substantially monolithic structure, or may comprise a plurality of connected (e.g., attached, coupled, bonded, etc.) structures. As used herein, the term "monolithic structure" means and includes a structure formed as, and comprising a single, unitary structure of a material. In some embodiments, the outer housing 101 is formed of and includes a plurality of connected structures (e.g., segments). By way of non-limiting example, the outer housing 101 may be formed of and include a first structure operatively associated with and configured to at least partially contain the opposing propellant structures 102, a second structure operatively associated with and configured to at least partially contain the second propellant structure 104, and a third structure interposed between and connected to each of the first structure and the second structure and exhibiting at least a portion of the apertures 110 therein. Forming the outer housing 101 from a plurality of connected structures may permit at least some of the connected structures to be reused following the use of the downhole stimulation tool 100 to stimulate of a producing formation in a wellbore. The plurality of connected structures may be coupled to one another using conventional processes and equipment, which are not described in detail herein.

The outer housing 101 may exhibit any configuration of the apertures 110 sufficient to vent gases produced during use and operation of the downhole stimulation tool 100, and also sufficient to at least partially (e.g., substantially) maintain the structural integrity of the outer housing 101 during the use and operation of the downhole stimulation tool 100. The position, quantity, dimensions (e.g., size and shape), and spacing (e.g., separation) of the apertures 110 may at least partially depend on the configurations and methods of initiating and combusting (e.g., burning) the opposing propellant structures 102. As depicted in FIG. 1, in some embodiments, such as in embodiments wherein the opposing propellant structures 102 are positioned and configured to be initiated and combusted from opposing ends proximate the lateral axis 112 of the outer housing 101, the apertures 110 may be located proximate to the lateral axis 112 of the outer housing 101. In additional embodiments, such as in embodiments wherein the opposing propellant structures 102 are positioned and configured to be initiated and combusted from one or more different locations, the apertures 110 may be located at different positions along the outer housing 101 of the downhole stimulation tool 100. Non-limiting examples of such different locations are described in further detail below. Each of the apertures 110 may exhibit substantially the same dimensions and substantially the same spacing relative to adjacent apertures, or at least one of the apertures 110 may exhibit at least one of different dimensions and different spacing relative to at least one other of the apertures 110.

Each of the opposing propellant structures 102 may comprise a composite structure formed of and including at least two regions exhibiting mutually different propellants. For example, as shown in FIG. 1, the opposing propellant structures 102 may each be formed of and include higher combustion rate regions 102*a* and lower combustion rate regions 102*b*. The regions 102*a*, 102*b* may also be characterized, as is commonly done by those of ordinary skill in the art, as propellant "grains." The higher combustion rate regions 102*a* may be formed of and include at least one propellant exhibiting a combustion rate within a range of from about 0.1 inch per second (in/sec) to about 4.0 in/sec at 1,000 pounds per square inch (psi) at an ambient temperature of about 70° F. In turn, the lower combustion rate regions 102*b* may be formed of and include at least one different propellant exhibiting a lower combustion rate than the higher combustion rate regions 102*a* within a range of from about 0.1 in/sec to about 4.0 in/sec at 1,000 psi at an ambient temperature of about 70° F. Combustion rates of propellants will vary, as known to those of ordinary skill in the art, with exposure to pressure and temperature conditions at variance from the above pressure and temperature conditions, such as those experienced by a propellant before and during combustion.

While various embodiments herein describe or illustrate the opposing propellant structures 102 as being formed of and including higher combustion rate regions 102*a* each exhibiting a first combustion rate, and lower combustion rate regions 102*b* each exhibiting a second, lower combustion rate, the opposing propellant structures 102 may, alternatively, each be formed of and include at least one additional region exhibiting at least one different combustion rate than both the higher combustion rate regions 102*a* and the lower combustion rate regions 102*b*. For example, each of the opposing propellant structures 102 may be formed of and include at least three regions each exhibiting a mutually different combustion rate and each comprising a mutually different propellant, at least four regions each exhibiting a mutually different combustion rate and each comprising a mutually different propellant, or more than four regions each exhibiting a mutually different combustion rate and each comprising a mutually different propellant.

The opposing propellant structures 102 may be formed of and include any desired quantity (e.g., number) and sequence (e.g., pattern) of the higher combustion rate regions 102*a* and the lower combustion rate regions 102*b* facilitating the stimulation of a producing formation in a wellbore in a pre-determined way, as described in further detail below. By way of non-limiting example, as shown in FIG. 1, each of the opposing propellant structures 102 may be formed of and include an alternating sequence of the higher combustion rate regions 102*a* and the lower combustion rate regions 102*b*. The opposing propellant structures 102 may each exhibit substantially the same alternating sequence of the higher combustion rate regions 102*a* and the lower combustion rate regions 102*b*, beginning with one of the higher combustion rate regions 102*a* at a location proximate the lateral axis 112 of the outer housing 101 and extending in opposite directions to distal ends of the outer housing 101.

While various embodiments herein describe or illustrate the opposing propellant structures 102 as each being formed of and including multiple (e.g., a plurality of) higher combustion rate regions 102*a* and multiple lower combustion rate regions 102*b* in an alternating sequence with one another beginning with one of the higher combustion rate regions 102*a* at a location proximate the lateral axis 112 of the outer housing 101, each of the opposing propellant structures 102 may, alternatively, be formed of and include at least one of a different quantity and a different sequence of the higher combustion rate regions 102*a* and the lower combustion rate regions 102*b*. For example, each of the opposing propellant structures 102 may include a single higher combustion rate region 102*a* and multiple lower combustion rate regions 102*b*, or each of the opposing propellant structures 102 may include multiple higher combustion rate regions 102*a* and a single lower combustion rate region 102*b*. As another example, each of the opposing propellant structures 102 may exhibit an alternating sequence of the higher combustion rate regions 102*a* and the lower combustion rate regions 102*b* beginning with one of the lower combustion rate regions 102*b* at a location proximate the lateral axis 112 of the outer housing 101. The quantity and the sequence of the higher combustion rate regions 102*a* and the lower combustion rate regions 102*b* may at least partially depend on the material composition of the producing formation to be stimulated, as well as downhole pressure and temperature in a wellbore adjacent such a producing formation, as described in further detail below.

Propellants of the opposing propellant structures 102 (e.g., propellant(s) of the higher combustion rate regions 102*a*, and propellant(s) of the lower combustion rate regions 102*b*) suitable for implementation of embodiments of the disclosure may include, without limitation, materials used as solid rocket motor propellants. Various examples of such propellants and components thereof are described in Thakre et al., *Solid Propellants*, Rocket Propulsion, Volume 2, Encyclopedia of Aerospace Engineering, John Wiley & Sons, Ltd. 2010, the disclosure of which document is hereby incorporated herein in its entirety by this reference. The propellants may be class 4.1, 1.4 or 1.3 materials, as defined by the United States Department of Transportation shipping classification, so that transportation restrictions are minimized.

By way of non-limiting example, the propellants of the opposing propellant structures 102 may each independently be formed of and include a polymer having at least one of a fuel and an oxidizer incorporated therein. The polymer may be an energetic polymer or a non-energetic polymer, such as glycidyl nitrate (GLYN), nitratomethylmethyloxetane (NMMO), glycidyl azide (GAP), diethyleneglycol triethyleneglycol nitraminodiacetic acid terpolymer (9DT-NIDA), bis(azidomethyl)-oxetane (BAMO), azidomethylmethyl-oxetane (AMMO), nitraminomethyl methyloxetane (NAMMO), bis(difluoroaminomethyl)oxetane (BFMO), difluoroaminomethylmethyloxetane (DFMO), copolymers thereof, cellulose acetate, cellulose acetate butyrate (CAB), nitrocellulose, polyamide (nylon), polyester, polyethylene, polypropylene, polystyrene, polycarbonate, a polyacrylate, a wax, a hydroxyl-terminated polybutadiene (HTPB), a hydroxyl-terminated poly-ether (HTPE), carboxyl-terminated polybutadiene (CTPB) and carboxyl-terminated polyether (CTPE), diaminoazoxy furazan (DAAF), 2,6-bis(picrylamino)-3,5-dinitropyridine (PYX), a polybutadiene acrylonitrile/acrylic acid copolymer binder (PBAN), polyvinyl chloride (PVC), ethylmethacrylate, acrylonitrile-butadiene-styrene (ABS), a fluoropolymer, polyvinyl alcohol (PVA), or combinations thereof. The polymer may function as a binder, within which the at least one of the fuel and oxidizer is dispersed. The fuel may be a metal, such as aluminum, nickel, magnesium, silicon, boron, beryllium, zirconium, hafnium, zinc, tungsten, molybdenum, copper, or titanium, or alloys mixtures or compounds thereof, such as aluminum hydride ($AlH_3$), magnesium hydride ($MgH_2$), or borane compounds ($BH_3$). The metal may be used in powder form. The oxidizer may be an inorganic perchlorate, such as ammonium perchlorate or potassium perchlorate, or an inorganic nitrate, such as ammonium nitrate or potassium nitrate. Other oxidizers may also be used, such as hydroxylammonium nitrate (HAN), ammonium dinitramide (ADN), hydrazinium nitroformate, a nitramine, such as cyclotetramethylene tetranitramine (HMX), cyclotrimethylene trinitramine (RDX), 2,4,6,8,10,12-hexanitro-2,4,6,8,10,12-hexaazaisowurtzitane (CL-20 or HNIW), and/or 4,10-dinitro-2,6,8,12-tetraoxa-4,10-diazatetracyclo-[5.5.0.0$^{5,9}$.0$^{3,11}$]-dodecane (TEX). In addition, one or more of the propellants of the opposing propellant structures 102 may include additional components, such as at least one of a plasticizer, a bonding agent, a combustion rate modifier, a ballistic modifier, a cure catalyst, an antioxidant, and a pot life extender, depending on the desired properties of the propellant. These additional components are well known in the rocket motor art and, therefore, are not described in detail herein. The components of the propellants of the opposing propellant structures 102 may be combined by conventional techniques, which are not described in detail herein.

Each of the regions of the opposing propellant structures 102 may be substantially homogeneous. For example, each of the higher combustion rate regions 102*a* may be formed of and include a single propellant, and each of the lower combustion rate regions 102*b* may be formed of and include a single, different propellant. In additional embodiments, one or more of the regions of the opposing propellant structures 102 may be heterogeneous. For example, one or more of the higher combustion rate regions 102*a* and/or the lower combustion rate regions 102*b* may comprise a composite structure formed of and including a volume of one propellant at least partially surrounded by a volume of another, different propellant, such as one or more of the composite structures described in U.S. patent application Ser. No. 13/781,217, now U.S. Pat. No. 9,447,672, issued Sep. 20, 2016, the disclosure of which was previously incorporated herein in its entirety by this reference.

Regions of the opposing propellant structures 102 exhibiting substantially the same combustion rate (e.g., each of the higher combustion rate regions 102*a*, each of the lower combustion rate regions 102*b*, etc.) may each be formed of and include substantially the same propellant, or at least one of the regions exhibiting substantially the same combustion rate may be formed of and include a different propellant than at least one other of the regions exhibiting substantially the same combustion rate. For example, each of the higher combustion rate regions 102*a* of the opposing propellant structures 102 may be formed of and include substantially the same propellant, or at least one of the higher combustion rate regions 102*a* may be formed of and include a different propellant than at least one other of the higher combustion rate regions 102*a*. As another example, each of the lower combustion rate regions 102*b* of the opposing propellant structures 102 may be formed of and include substantially the same propellant, or at least one of the lower combustion rate regions 102*b* may be formed of and include a different propellant than at least one other of the lower combustion rate regions 102*b*.

Each of the regions of the opposing propellant structures 102 (e.g., each of the higher combustion rate regions 102*a*, each of the lower combustion rate regions 102*b*, etc.) may exhibit substantially the same volume of propellant, or at least one of the regions of the opposing propellant structures 102 may exhibit a different volume of propellant than at least one other of the regions of the opposing propellant structures 102. For example, each of the higher combustion rate regions 102*a* of the opposing propellant structures 102 may exhibit substantially the same volume of propellant, or at least one of the higher combustion rate regions 102*a* may exhibit a different volume of propellant than at least one other of the higher combustion rate regions 102*a*. As another example, each of the lower combustion rate regions 102*b* of the opposing propellant structures 102 may exhibit substantially the same volume of propellant, or at least one of the lower combustion rate regions 102*b* may exhibit a different volume of propellant than at least one other of the lower combustion rate regions 102*b*. The volumes selected for the different regions of the opposing propellant structures 102 may at least partially depend on the material composition of the producing formation to be stimulated, as described in further detail below.

As shown in FIG. 1, in some embodiments, the opposing propellant structures 102 exhibit substantially the same configuration (e.g., substantially the same dimensions, propellants, propellant regions, propellant region combustion rates, propellant region sequences, propellant region volumes, etc.) as one another, but are located at different positions and extend in opposite directions within the outer housing 101. Put another way, the configurations of the opposing propellant structures 102 may substantially longitudinally mirror one another within the outer housing 101 about lateral axis 112. In additional embodiments, the opposing propellant structures 102 exhibit mutually different configurations. For example, the opposing propellant structures 102 may exhibit at least one of mutually different dimensions, mutually different propellants, mutually different propellant regions, mutually different propellant region combustion rates, mutually different propellant region sequences, and mutually different propellant region volumes. The configurations of the opposing propellant structures 102 relative to one another may be selected at least partially based on desired characteristics (e.g., movement characteristics within a wellbore) of the downhole stimulation tool during stimulation of a producing formation in a wellbore, and on a material composition of the producing formation to be stimulated, as described in further detail below.

The configurations of the opposing propellant structures 102 may be selected (e.g., tailored) to substantially minimize, and desirably prevent, movement of the downhole stimulation tool 100 during stimulation of a producing formation in a wellbore. For example, the configuration of one of the opposing propellant structures 102 may be selected relative to the configuration of the other of opposing propellant structures 102 such that the downhole stimulation tool 100 exhibits substantially neutral thrust (e.g., neither forward (downward) thrust, nor reverse (upward) thrust within the wellbore in which the downhole stimulation tool 100 is deployed) during combustion of the opposing propellant structures 102. The one of the opposing propellant structures 102 may produce thrust in one direction and the other of the opposing propellant structures 102 may produce substantially the same amount of thrust in an opposing direction, such that the downhole stimulation tool 100 exhibits substantially no movement during stimulation of a producing formation in a wellbore. In additional embodiments, the configurations of the opposing propellant structures 102 may result in some movement of the downhole stimulation tool 100 during stimulation of a producing formation in a wellbore. For example, the differences in one or more of the dimensions, positions, propellants, propellant regions, propellant region combustion rates, propellant region sequences, and propellant region volumes of the opposing propellant structures 102 may cause the downhole stimulation tool 100 to exhibit some forward thrust and/or some reverse thrust during combustion of the opposing propellant structures 102. At least in such embodiments, one or more anchoring systems may, optionally, be employed to substantially limit undesired movement of the downhole stimulation tool 100 during stimulation of a producing formation in a wellbore. For example, if the configurations of the opposing propellant structures 102 would result in movement of the downhole stimulation tool 100 during combustion of the opposing propellant structures 102, at least one anchoring system may be utilized with the downhole stimulation tool 100 to substantially mitigate or prevent such movement of the downhole stimulation tool 100. Suitable anchoring systems are well known in the art, and are therefore not described in detail herein.

In addition, the configurations of the opposing propellant structures 102 may be selected based on a material composition of the producing formation to be stimulated by the downhole stimulation tool 100. For example, the opposing propellant structures 102 may be configured to achieve a pre-determined pressure profile (e.g., pressure trace, pressure curve), which pressure profile may also be characterized as a ballistic trace, within a producing formation during the use and operation of the downhole stimulation tool 100, the selected pressure profile at least partially determined by the geologic strata of the producing formation. The opposing propellant structures 102 may be configured to generate controlled variances in pressure (e.g., increased pressure, decreased pressure) and durations of such variances of pressure within the producing formation during the combustion of the opposing propellant structures 102. By way of non-limiting example, a pressure level within the producing formation may increase (e.g., rise) when the higher combustion rate regions 102*a* begin to combust, and may decrease (e.g., drop) during the combustion of the lower combustion rate regions 102*b*. Of course, after initial propellant burn has commenced and pressure is elevated above hydrostatic wellbore pressure, such increases and decreases in pressure, and durations of such variances, may be effected relative to a baseline elevated pressure above hydrostatic.

Figure 2:
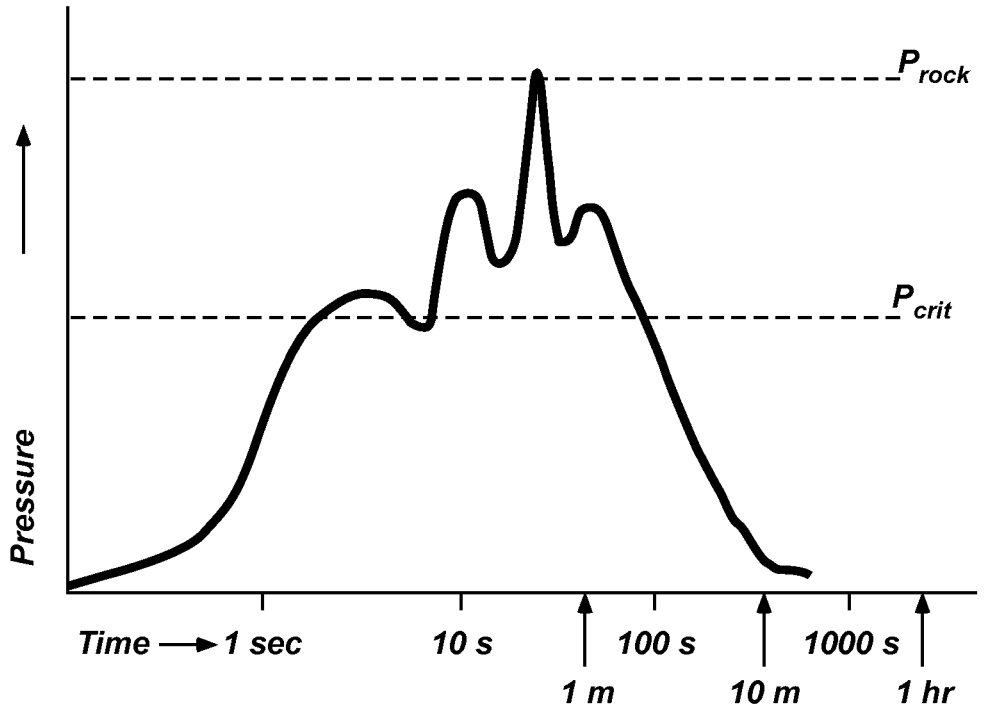
FIG. 2 is a schematic graphic depiction of a pressure trace for a downhole stimulation tool according to an embodiment of the disclosure.

In one example of a tailored, non-uniform pressure profile that may be termed a "sawtooth" profile, and as illustrated graphically in FIG. 2, a relatively high pressure level significantly above hydrostatic may be generated initially, followed by a drop to a relatively low pressure above hydrostatic, followed by a rise to another relatively higher pressure level, followed by a drop to another relatively low pressure level above the first low pressure, followed by a rise to an even relatively higher pressure level, and so on. Such a pressure profile may be generated, for example, by the downhole stimulation tool 100 illustrated in FIG. 1, wherein the opposing propellant structures 102 each exhibit an alternating sequence of the higher combustion rate regions 102*a* and the lower combustion rate regions 102*b* beginning with a high combustion rate region 102*a* positioned with a face at a location proximate the lateral axis 112 of the downhole stimulation tool 100. The durations of the higher pressure levels and lower pressure levels may be controlled at least partially by relative combustion rates as well as the volumes of the different combustion rate regions of the opposing propellant structures 102.

Various configurations of the opposing propellant structures 102 for various producing formation material compositions may be selected and produced using mathematical modeling. The mathematical modeling may be based upon ballistics codes for solid rocket motors but adapted for physics (i.e., pressure and temperature conditions) experienced downhole, as well as for the presence of apertures for gas from combusting opposing propellant structures 102 to exit an outer housing. The ballistics codes may be extrapolated with a substantially time-driven combustion rate. Of course, the codes may be further refined over time by correlation to multiple iterations of empirical data obtained in physical testing under simulated downhole environments and actual downhole operations. Such modeling has been conducted with regard to conventional downhole propellants in academia and industry as employed in conventional configurations. An example of software for such modeling may include PULSFRAC® software developed by John F. Schatz Research & Consulting, Inc. of Del Mar, Calif., and now owned by Baker Hughes Incorporated of Houston, Tex. and licensed to others in the oil service industry. However, the ability to tailor variable propellant combustion characteristics (and, hence, variable pressure characteristics) of extended duration, as enabled by embodiments of the disclosure, to the particular stimulation needs of producing formations has not been recognized or implemented in the state of the relevant art.

Referring collectively to FIGS. 1 and 2, during use and operation of the downhole stimulation tool 100, combustion of the opposing propellant structures 102 generates high pressure gases that may be used to raise the pressure within a producing formation above the minimum stress capability of rock thereof ($P_{CRIT}$) (i.e., the minimum stress level at or above which the rock begins to fracture), and then sustainably vary pressure levels within the producing formation between the $P_{CRIT}$ and the maximum compressive strength of the rock ($P_{ROCK}$). Accordingly, the downhole stimulation tool 100 may facilitate the efficient formation, opening, and expansion of factures within the producing formation without substantial risk of damage to the wellbore. For example, the combustion of the initial higher combustion rate regions 102*a* of the opposing propellant structures 102 may form initial factures within the rock of the producing formation, the subsequent combustion of the sequentially adjacent lower combustion rate regions 102*b* may maintain and/or open (e.g., increase the volume of) the initial factures, the subsequent combustion of the next sequentially adjacent higher combustion rate regions 102*a* may extend (e.g., propagate) the opened fractures farther (e.g., radially deeper) into the rock of the producing formation, the subsequent combustion of the next sequentially adjacent lower combustion rate regions 102*b* may maintain and/or open the extended fractures, and so on to a desired radial distance from the wellbore (e.g., from about ten feet to about one hundred feet or more from the wellbore).

The opposing propellant structures 102 may each be formed using conventional processes and conventional equipment, which are not described in detail herein. By way of non-limiting example, different regions of the opposing propellant structures 102 (e.g., the higher combustion rate regions 102*a*, the lower combustion rate regions 102*b*, etc.) may be conventionally cast, conventionally extruded, and/or conventionally machined from selected propellants to a substantially common diameter, and then arranged longitudinally relative to one another and placed within outer housing 101 to form the opposing propellant structures 102. In some embodiments, the opposing propellant structures may be preassembled prior to transport to a rig site of a wellbore of a producing formation to be stimulated. In additional embodiments, the opposing propellant structures 102 may be readily assembled at the rig site of a wellbore in a producing formation from multiple, pre-formed propellant structures transported to the rig site, and selected and configured based on the pre-determined (e.g., by way of mathematical modeling, previous experience, or combinations thereof) stimulation needs of the producing formation. The opposing propellant structures 102 may also be produced in the field by severing selected lengths of propellant grains of particular types from longer propellant grains and then assembling the selected lengths of the propellant grains relative to one another.

Optionally, at least one of a heat insulator, a combustion inhibitor, and a liner may be interposed between the outer housing 101 and each of the opposing propellant structures 102. The heat insulator may be configured and positioned to protect (e.g., shield) the outer housing 101 from damage associated with the high temperatures and high velocity particles produced during combustion of the opposing propellant structures 102. The combustion inhibitor may be configured and positioned to thermally protect and at least partially control the ignition and combustion of the opposing propellant structures 102, including the different regions thereof (e.g., the higher combustion rate regions 102*a*, the lower combustion rate regions 102*b*, etc.). The liner may be configured and positioned to bond (e.g., directly bond, indirectly bond) the opposing propellant structures 102 to at least one of the heat insulating layer and the outer housing 101. The liner may also be configured to prevent, by substantially limiting, interactions between the opposing propellant structures 102 and wellbore fluids during use and operation of the downhole stimulation tool 100. The liner may, for example, prevent leaching of the propellants of the opposing propellant structures 102 into the downhole environment during use and operation of the downhole stimulation tool 100. In some embodiments, the heat insulator is formed (e.g., coated, applied, etc.) on or over an inner surface of the outer housing 101, the combustion inhibitor is formed (e.g., coated, applied, etc.) on or over peripheral surfaces of the opposing propellant structures 102, and the liner is formed on or over the combustion inhibitor layer. Suitable heat insulators, suitable combustion inhibitors, and suitable liners, and as well as a process of forming the heat insulating layers, the combustion inhibitors, and the liners, and are known in the art, and therefore are not described in detail herein. In some embodiments, the combustion inhibitor comprises substantially the same polymer as a polymer of at least one propellant of the opposing propellant structures 102 (e.g., PVC if a propellant of the opposing propellant structures 102 is formed of includes PVC, etc.), and the liner comprises at least one of an epoxy, a urethane, a cyanoacrylate, a fluoroelastomer, mica, and graphite, such as the materials described in U.S. Pat. Nos. 7,565,930, 7,950,457 and 8,186,435 to Seekford, the disclosure of each of which is incorporated herein in its entirety by this reference.

Referring again to FIG. 1, the initiators 104 may be configured and positioned to facilitate the ignition and combustion (e.g., the substantially simultaneous ignition and combustion) of the opposing propellant structures 102. For example, as shown in FIG. 1, two of the initiators 104 may be separately provided adjacent opposing ends 106 of the opposing propellant structures 102 proximate the lateral axis 112 of the outer housing 101. The initiators 104 may thus facilitate the ignition and combustion of the opposing propellant structures 102 from the opposing ends 106 of the opposing propellant structures 102. As depicted in FIG. 1, the initiators 104 may be positioned adjacent the opposing ends 106 of the opposing propellant structures 102 along the longitudinal axis 114 of the outer housing 101. In additional embodiments, one or more of the initiators 104 may be positioned adjacent at least one of the opposing ends 106 of the opposing propellant structures 102 at a different position, such as at a position offset from the longitudinal axis 114 of the outer housing 101. In further embodiments, multiple initiators 104 may be employed over an end of a propellant structure 102 to ensure fail-safe operation. Each of the initiators 104 may be of conventional design, and may be activated using conventional processes and equipment, which are not described in detail herein. However, activation of the initiators 104 using electrical signals carried by a wireline extending to the downhole stimulation tool 100 is specifically contemplated, as is activation using a trigger mechanism activated by increased wellbore pressure, or pressure within a tubing string (such term including coiled tubing) at the end of which the downhole stimulation tool 100 is deployed. By way of non-limiting example, at least one of the initiators 104 may comprise a semiconductive bridge (SCB) initiating device, such as those described in U.S. Pat. Nos. 5,230,287 and 5,431,101 to Arrell, Jr. et al., the disclosure of each of which is hereby incorporated herein in its entirety by this reference. Optionally, one or more materials and/or structures (e.g., caps) may be provided on or over the initiators 104 to prevent, by substantially limiting, interactions between the initiators 104 and wellbore fluids during use and operation of the downhole stimulation tool 100. Suitable materials and/or structures are well known in the art, and are therefore not described in detail herein.

Figure 3:
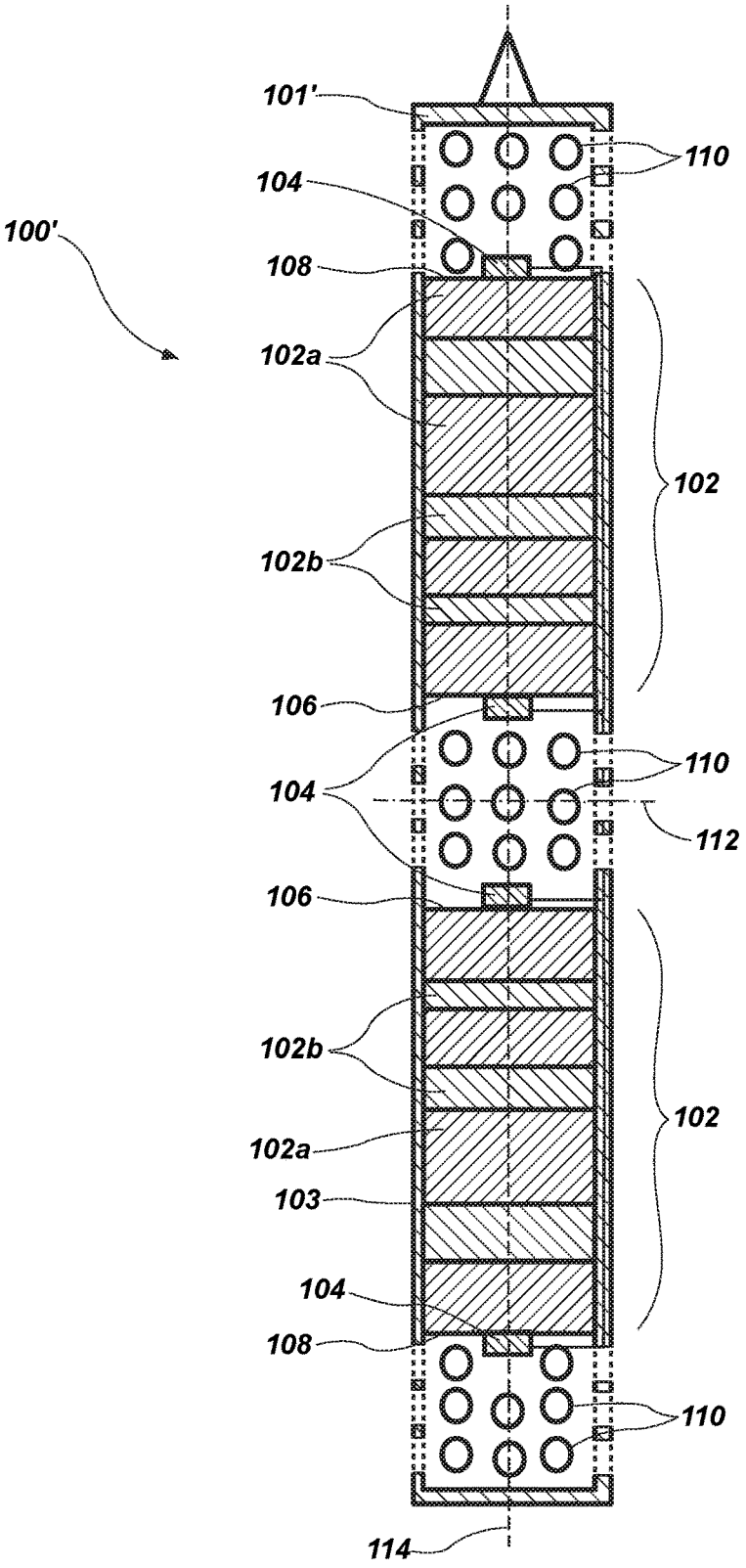
FIG. 3 is a longitudinal, cross-sectional view of a downhole stimulation tool, in accordance with additional embodiments of the disclosure.

One of ordinary skill in the art will appreciate that, in accordance with additional embodiments of the disclosure, the initiators 104 may be provided at different locations on, over, and/or within the opposing propellant structures 102 of the downhole stimulation tool 100. By way of non-limiting example, FIG. 3 illustrates a longitudinal, cross-sectional view of a downhole stimulation tool 100' in accordance with another embodiment of the disclosure. The downhole stimulation tool 100' may be substantially similar to the downhole stimulation tool 100 previously described, except that the downhole stimulation tool 100' may include a greater number of the initiators 104, and may also include an outer casing 101' exhibiting a greater number of the apertures 110.

As shown in FIG. 3, the initiators 104 may be located on or over the opposing ends 106 of the opposing propellant structures 102, and on or over other ends 108 of the opposing propellant structures 102 distal from the lateral axis 112 of the outer housing 101'. Providing the initiators 104 on or over each of the opposing ends 106 and the other ends 108 of the opposing propellant structures 102 may facilitate the initiation of multiple combustion fronts on at least one of (e.g., each of) the opposing propellant structures 102. For example, providing the initiators 104 on or over each of the opposing ends 106 and the other ends 108 of the opposing propellant structures 102 may facilitate the initiation and combustion of the opposing propellant structures 102 from each of the opposing ends 106 and the other ends 108. One or more devices and processes may be utilized to activate (e.g., trigger, fire, etc.) selected initiators 104 substantially simultaneously, or to activate at least one of the initiators 104 (e.g., initiators 104 adjacent the opposing ends 106 or the other ends 108 of the opposing propellant structures 102) in sequence with at least one other of the initiators 104 (e.g., other initiators 104 adjacent the other of the opposing ends 106 or the other ends 108). Suitable devices and processes for activating the initiators 104 simultaneously and/or sequentially are known in the art, and are therefore not described in detail herein. A non-limiting example of a suitable activation assembly is a wireline extending to a processor-controlled multiplexor carried by the downhole stimulation tool 100, the processor is pre-programmed to initiate a firing sequence for the initiators 104. Non-limiting examples of other suitable activation assemblies include electronic time delay assemblies and pyrotechnic time delay assemblies, such as one or more of the assemblies described in U.S. Pat. No. 7,789,153 to Prinz et al., the disclosure of which is hereby incorporated herein in its entirety by this reference.

The outer housing 101' of the downhole stimulation tool 100' may include an additional number of the apertures 110 to account for the additional combustion fronts that may be formed on the opposing propellant structures 102 through activation of multiple initiators 104. The outer housing 101' may include any position, quantity, dimensions (e.g., size and shape), and spacing (e.g., separation) of the additional number of the apertures 110 sufficient to vent the gases produced during the combustion of the opposing propellant structures 102, and also sufficient to at least partially (e.g., substantially) maintain the structural integrity of the outer housing 101' during the use and operation of the downhole stimulation tool 100'. For example, as shown in FIG. 3, the additional number of the apertures 110 may be located at and/or proximate opposing ends of the outer housing 101' distal from the lateral axis 112 of the outer housing 101'.

Figure 4:
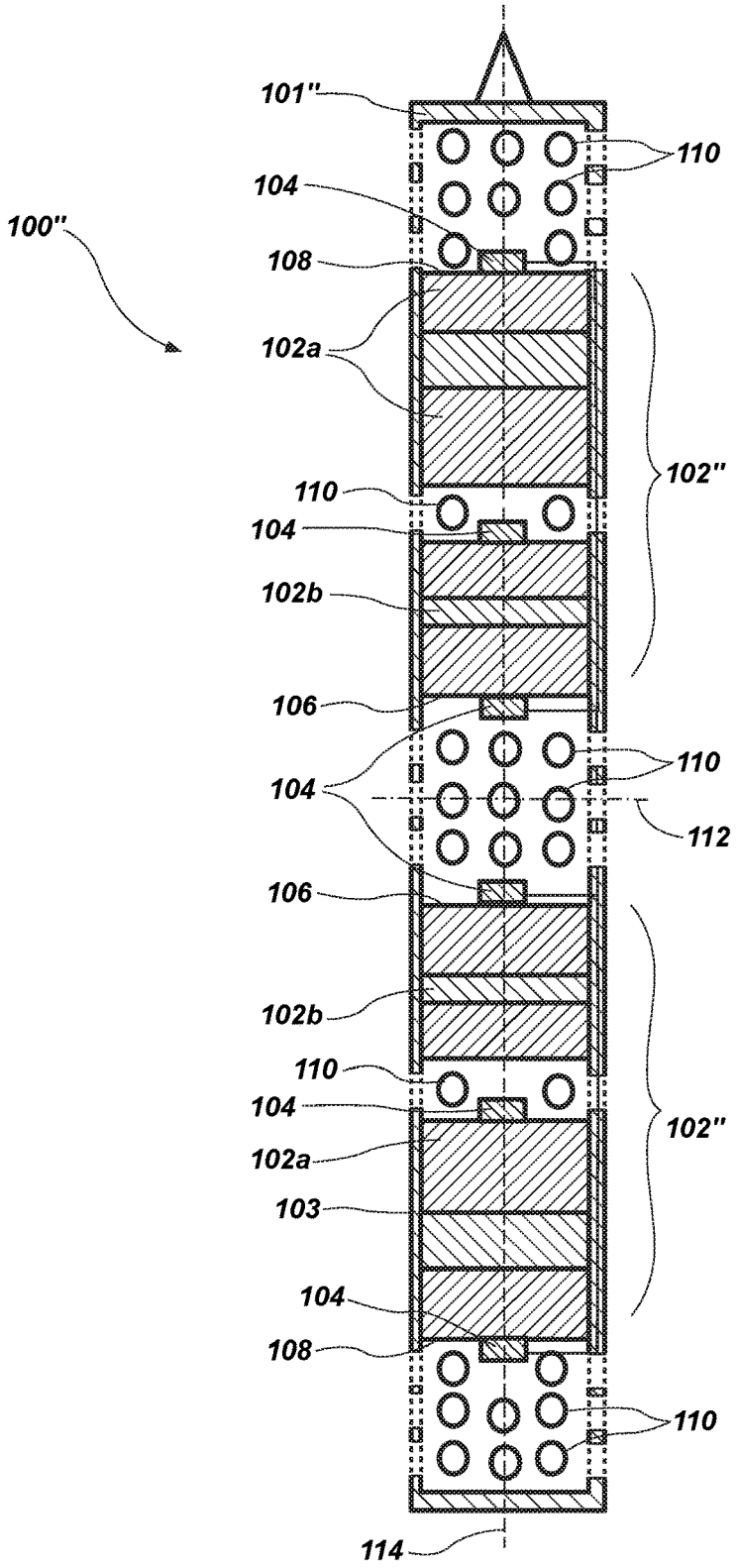
FIG. 4 is a longitudinal, cross-sectional view of a downhole stimulation tool, in accordance with further embodiments of the disclosure.

In addition, in accordance with further embodiments of the disclosure, the initiators 104 may be provided at additional, different locations within the downhole stimulation tool 100'. By way of non-limiting example, FIG. 4 illustrates a longitudinal, cross-sectional view of a downhole stimulation tool 100" in accordance with a further embodiment of the disclosure. The downhole stimulation tool 100" may be substantially similar to the downhole stimulation tool 100' previously described, except that the downhole stimulation tool 100" may include an even greater number of the initiators 104, may exhibit modified opposing propellant structures 102" configured to account for the even greater number of the initiators 104, and may also include an outer casing 101" exhibiting an even greater number of the apertures 110.

As shown in FIG. 4, one or more of the initiators 104 may be positioned between at least two longitudinally inward regions of each of the opposing propellant structures 102". For example, one or more of the initiators 104 may be provided on or over at least one longitudinally inward higher combustion rate region **102*a* of each of the opposing propellant structures 102", and/or one or more of the initiators 104 may be provided on or over at least one longitudinally inward lower combustion rate region 102*b* of each of the opposing propellant structures 102". The opposing propellant structures 102" may be substantially similar to the opposing propellant structures 102 previously described, except that two or more longitudinally adjacent regions of each of the opposing propellant structures 102" may be offset (e.g., separated, spaced, etc.) from one another so that one or more of the initiators 104 may be provided therebetween (e.g., on or over a surface of at least one of the longitudinally adjacent regions). Providing the initiators 104 between longitudinally adjacent regions of each of the opposing propellant structures 102" may facilitate the selective initiation of additional combustion fronts on at least one of (e.g., each of) the opposing propellant structures 102". For example, providing at least some of the initiators 104 adjacent one or more of the longitudinally inward higher combustion rate regions 102*a* and/or the longitudinally inward lower combustion rate regions 102*b* may facilitate the selective, precisely timed initiation and combustion of the one or more of the longitudinally inward higher combustion rate regions 102*a* and/or the longitudinally inward lower combustion rate regions 102*b*. Such selective, precisely timed initiation and combustion may facilitate the initiation of desired combustion fronts (and, hence, the generation of desired amounts of gas) over a desired time interval not wholly dependent upon the combustion rates of the various propellants employed. Similar to the downhole stimulation tool 100' previously described, one or more devices and processes may be utilized to activate selected initiators 104 substantially simultaneously, or to activate at least one of the initiators 104 (e.g., at least one of the initiators 104 adjacent one or more of the higher combustion rate regions 102***a* and the lower combustion rate regions 102*b*) in sequence with at least one other of the initiators 104 (e.g., at least one other of the initiators 104 adjacent one or more of other of the higher combustion rate regions 102*a* and the lower combustion rate regions 102*b*). Suitable devices and processes include, but are not limited to, the devices and processes previously described in relation to the downhole stimulation tool 100'.

The outer housing 101" of the downhole stimulation tool 100" may include an additional number of the apertures 110 to account for the additional combustion fronts that may be formed on the opposing propellant structures 102" through activation of multiple initiators 104. The outer housing 101" may include any position, quantity, dimensions (e.g., size and shape), and spacing (e.g., separation) of the additional number of the apertures 110 sufficient to vent the gases produced during the combustion of the opposing propellant structures 102", and also sufficient to at least partially (e.g., substantially) maintain the structural integrity of the outer housing 101" during the use and operation of the downhole stimulation tool 100". As shown in FIG. 4, the additional number of the apertures 110 may, for example, be located proximate the initiators 104 positioned between adjacent longitudinally inward regions of each of the opposing propellant structures 102", such as at one or more locations between the lateral axis 112 of the outer housing 101" and the opposing ends of the outer housing 101".

Figure 5:
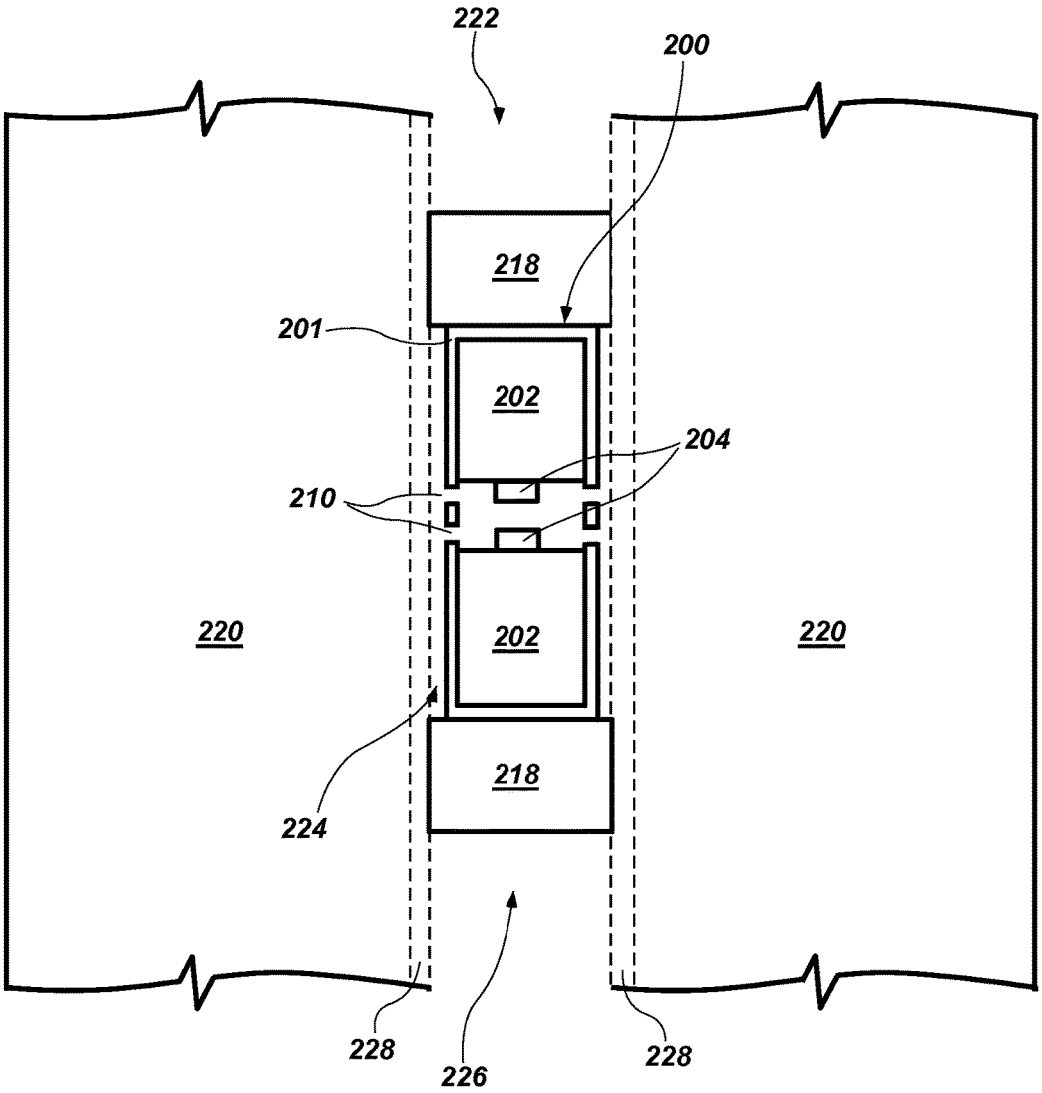
FIG. 5 is a longitudinal schematic view illustrating a method of stimulating a producing formation adjacent a wellbore using a downhole stimulation tool, in accordance with embodiments of the disclosure.

FIG. 5 is a longitudinal schematic view illustrating the use of a downhole stimulation tool 200 according to embodiments of the disclosure to stimulate at least one producing formation 220 adjacent a wellbore 222. The downhole stimulation tool 200 may be one of the downhole stimulation tools 100, 100', 100" previously described. The downhole stimulation tool 200 may be deployed to a pre-determined location within the wellbore 222 by conventional processes and equipment (e.g., wireline, tubing, coiled tubing, etc.), and may, optionally, be secured (e.g., anchored) into position. As shown in FIG. 5, the downhole stimulation tool 200 may, optionally, be deployed within a casing 228 lining the wellbore 222. The casing 228 may be any wellbore casing that does not substantially impede the stimulation of the producing formation 220 using the downhole stimulation tool 200. For example, if present, the casing 228 may exhibit a plurality of apertures through which high pressure gases exiting the downhole stimulation tool 200 may be introduced to the producing formation 220. After the downhole stimulation tool 200 is deployed, initiators 204 of the downhole stimulation tool 200 (e.g., the initiators 104 shown in FIGS. 1, 3, and 4) may be activated (e.g., simultaneously activated, sequentially activated, or combinations thereof), such as by electricity and/or pressure, to initiate the combustion (e.g., simultaneous combustion, sequential combustion, or combinations thereof) of one or more regions of each of opposing propellant structures 202 of the downhole stimulation tool 200 (e.g. the opposing propellant structures 102, 102" shown in FIGS. 1, 3, and 4). The combustion of the opposing propellant structures 202 generates high pressure gases in accordance with the configurations (e.g., dimensions, propellants, propellant regions, propellant region combustion rates, propellant region sequences, propellant region volumes, etc.) of the opposing propellant structures 202. The high pressure gases exit an outer housing 201 of the downhole stimulation tool 200 (e.g., the outer housings 101, 101', 101" shown in FIGS. 1, 3, and 4) through apertures 210 (e.g., the apertures 110 shown FIGS. 1, 3, and 4), and may be used to stimulate (e.g., fracture, perforate, clean, etc.) the producing formation 220, as previously described herein (e.g., by varying pressure levels and the pressure rise/fall rates within the producing formation 220). Stimulation of the producing formation 220 may be effected uniformly (e.g., 360° about a wellbore axis) or directionally (e.g., in a 45° arc, a 90° arc, etc., transverse to the wellbore axis). The downhole stimulation tool 200 may also be used for the re-stimulation of the producing formation 220, in conjunction with other stimulation methods (e.g., hydraulic fracturing), to reduce breakdown pressures of the producing formation 220, and as a substitute for other stimulation methods.

With continued reference to FIG. 5, the downhole stimulation tool 200 may be operatively associated with at least one additional structure and/or at least one additional device that assists in the efficient stimulation of a producing formation 220. For example, as shown in FIG. 5, the downhole stimulation tool 200 may be operatively associated with one or more sealing devices 218 (e.g., packers) configured and positioned to isolate a region 224 of the wellbore 222 adjacent the producing formation 220 and in which a high pressure is to be generated using the downhole stimulation tool 200 from one or more other regions 226 of the wellbore 222. The sealing devices 218 may be connected (e.g., attached, coupled, bonded, etc.) to the downhole stimulation tool 200, or may be separate and distinct from the downhole stimulation tool 200. In some embodiments, the sealing devices 218 are components of the downhole stimulation tool 200, such as one or more of the sealing devices described in U.S. patent application Ser. No. 14/491,246, filed Sep. 19, 2014, and entitled, and titled "METHODS AND APPARATUS FOR DOWNHOLE PROPELLANT-BASED STIMUATION WITH WELLBORE PRESSURE CONTAINMENT," which has previously been incorporated herein in its entirety by this reference. It has been recognized by the inventors herein that the generation of an extended duration elevated pressure pulse for stimulation may require physical containment within the wellbore interval in which a downhole stimulation tool 200 is located for optimum results, as hydrostatic pressure of wellbore fluids may be insufficient to contain the extended duration pulse without pressure-induced displacement of the wellbore fluid and consequent, undesirable pressure reduction.

Unlike conventional propellant-based stimulation techniques, embodiments of the disclosure enable generation and prolonged maintenance of a number of elevated pressures in a wellbore in communication with a producing formation for an extended duration. The ability to control levels, timing and durations of individual segments of a prolonged pressure pulse enables stimulation to be tailored to known parameters of a producing formation to be stimulated, such parameters being previously empirically determined by, for example, logging and/or coring operations, or known from completion of other wells intersecting the same producing formation. Thus, embodiments of the disclosure may enable stimulation of a producing formation over an extended period of time (e.g., a period of time greater than or equal to about 1 second, such as greater than or equal to about 5 seconds, greater than or equal to about 10 seconds, greater than or equal to about 20 seconds, or greater than or equal to about 60 seconds), which may be of benefit to enhance production of desired formation fluids from producing formations in various different geologic strata through improved fracturing, acidizing, cleaning and other stimulation techniques. Development and maintenance of an extended duration, multi-pressure pulse is enabled by the use of elongated propellant structures according to embodiments of the disclosure in the form of multiple propellant regions exhibiting a limited combustion front in the form of transverse cross-sections of the various regions as each region burns longitudinally within the outer housing.

Embodiments of the disclosure may be used to provide virtually infinite flexibility to tailor a pressure profile resulting from propellant combustion within a downhole environment to match particular requirements for stimulating a producing formation for maximum efficacy. For example, the configurations according to embodiments of the disclosure (e.g., the downhole stimulations tools 100, 100', 100" shown in FIGS. 1, 3, and 4), including the configurations of the opposing propellant structures, the initiators, and the outer housings, may facilitate the controlled, sustained variance of pressure within a producing formation adjacent a wellbore between the $P_{CRIT}$ and the $P_{ROCK}$ of the producing formation to maximize stimulation of the producing formation with minimal risk to the wellbore. The configurations of the downhole stimulation tools of the disclosure may also minimize (e.g., negate) movement of the downhole stimulation tools within the wellbore during use and operation, thereby reducing the risk of halted operations (e.g., to reposition the downhole stimulations tools), and/or undesirable damage to at least one of the downhole stimulation tools and the wellbore. In addition, the downhole stimulation tools may be easily assembled (e.g., in the field), and one or more components of the downhole stimulation tools (e.g., one or more portions of the outer housings 101, 101', 101" shown in FIGS. 1, 3, and 4) may be readily reused, reducing material and fabrication expenses associated with the fabrication and use of the downhole stimulation tools. The downhole stimulation tools and stimulation methods of the disclosure may significantly reduce the time, costs, and risks associated with getting a well on line and producing as compared to conventional downhole stimulation tools and conventional stimulation methods.

While the disclosure is susceptible to various modifications and alternative forms, specific embodiments have been shown by way of example in the drawings and have been described in detail herein. However, the disclosure is not limited to the particular forms disclosed. Rather, the disclosure is to cover all modifications, equivalents, and alternatives falling within the scope of the disclosure as defined by the following appended claims and their legal equivalents.

What is claimed is:

1. A downhole stimulation tool, comprising:

a substantially monolithic outer housing comprising:

two regions free of apertures extending therethrough; and an additional region longitudinally intervening between the two regions and exhibiting apertures extending therethrough;

opposing propellant structures substantially longitudinally confined within the two regions of the outer housing and each individually comprising:

at least one higher combustion rate propellant region; and at least one lower combustion rate propellant region longitudinally adjacent the at least one higher combustion rate propellant region; and at least one initiator adjacent each of the opposing propellant structures, wherein the additional region of the substantially monolithic outer housing is substantially free of propellant structures contained therein prior to the ignition of the opposing propellant structures.

2. The downhole stimulation tool of claim 1, wherein the at least one higher combustion rate propellant region comprises a plurality of higher combustion rate propellant regions, and the at least one lower combustion rate propellant region comprises a plurality of lower combustion rate propellant regions.

3. The downhole stimulation tool of claim 2, wherein at least one of the plurality of higher combustion rate propellant regions exhibits a different volume of propellant than at least one other of the plurality of higher combustion rate propellant regions, and at least one of the plurality of lower combustion rate propellant regions exhibits a different volume of another propellant than at least one other of the plurality of lower combustion rate propellant regions.

4. The downhole stimulation tool of claim 1, wherein each of the opposing propellant structures exhibits substantially the same longitudinal sequence of the at least one higher combustion rate propellant region and the at least one lower combustion rate propellant region extending in opposite directions from locations proximate a lateral axis of the outer housing.

5. The downhole stimulation tool of claim 1, wherein each of the opposing propellant structures exhibits an alternating sequence of the at least one higher combustion rate propellant region and the at least one lower combustion rate propellant region beginning with the at least one higher combustion rate propellant region at a location proximate a lateral axis of the outer housing.

6. The downhole stimulation tool of claim 1, wherein each of the opposing propellant structures further comprises at least one additional propellant region exhibiting a combustion rate different than combustion rates of the at least one higher combustion rate propellant region and the at least one lower combustion rate propellant region.

7. The downhole stimulation tool of claim 1, wherein the at least one higher combustion rate propellant region of each of the opposing propellant structures exhibits at least one different volume of propellant than the at least one lower combustion rate propellant region of each of the opposing propellant structures.

8. The downhole stimulation tool of claim 1, wherein the at least one initiator comprises:

a first initiator adjacent an end of one of the opposing propellant structures proximate a lateral axis of the outer housing; and a second initiator adjacent an opposing end of another of the opposing propellant structures proximate the lateral axis of the outer housing.

9. The downhole stimulation tool of claim 1, wherein the at least one initiator comprises a plurality of initiators adjacent the at least one higher combustion rate propellant region and the at least one lower combustion rate propellant region of each of the opposing propellant structures.

10. The downhole stimulation tool of claim 1, wherein:

the additional region is located proximate a lateral axis of the outer housing; and the outer housing further comprises at least two other regions each more longitudinally distal from the lateral axis of the substantially monolithic outer housing than the two regions and each exhibiting additional apertures extending therethrough.

11. A downhole stimulation tool, comprising:

an outer housing comprising:

a first structure free of apertures laterally extending therethrough;

a second structure free of apertures laterally extending therethrough; and a third structure connected to and longitudinally interposed between the first structure and the second structure and exhibiting apertures extending therethrough;

a propellant structure substantially longitudinally confined within the first structure of the outer housing and comprising:

at least one higher combustion rate propellant region; and at least one lower combustion rate propellant region adjacent the at least one higher combustion rate propellant region;

another propellant structure opposing the propellant structure and substantially longitudinally confined within the second structure of the outer housing, the another propellant structure comprising:

at least one other higher combustion rate propellant region; and at least one other lower combustion rate propellant region adjacent the at least one other higher combustion rate propellant region; and initiators adjacent each of the propellant structure and the another propellant structure, wherein the additional region of the outer housing is substantially free of propellant structures contained therein prior to the ignition of the propellant structure and the another propellant structure.

12. The downhole stimulation tool of claim 11, wherein the at least one higher combustion rate propellant region of the propellant structure exhibits substantially the same combustion rate as the at least one other higher combustion rate propellant region of the another propellant structure, and the at least one lower combustion rate propellant region of the first propellant structure exhibits substantially the same combustion rate as the at least one other lower combustion rate propellant region of the another propellant structure.

13. The downhole stimulation tool of claim 11, wherein the at least one higher combustion rate propellant region of the propellant structure and the at least one other higher combustion rate propellant region of the another propellant structure each comprise a first propellant, and the at least one lower combustion rate propellant region of the propellant structure and the at least one other lower combustion rate propellant region of the another propellant structure each comprise a second, different propellant.

14. The downhole stimulation tool of claim 11, wherein the at least one higher combustion rate propellant region of the propellant structure and the at least one other higher combustion rate propellant region of the another propellant structure each comprise at least one mutually different propellant.

15. The downhole stimulation tool of claim 11, wherein the at least one lower combustion rate propellant region of the propellant structure and the at least one other lower combustion rate propellant region of the another propellant structure each comprise at least one mutually different propellant.

16. The downhole stimulation tool of claim 11, wherein a sequence of the at least one higher combustion rate propellant region and the at least one lower combustion rate propellant region exhibited by the propellant structure is substantially the same as a sequence of the at least one other higher combustion rate propellant region and the at least one other lower combustion rate propellant region exhibited by the another propellant structure.

17. The downhole stimulation tool of claim 11, wherein the at least one higher combustion rate propellant region of the propellant structure and the at least one other higher combustion rate propellant region of the another propellant structure exhibit substantially the same volume of propellant and substantially the same transverse cross-sectional area as one another, and the at least one lower combustion rate propellant region of the propellant structure and the at least one other lower combustion rate propellant region of the another propellant structure exhibit substantially the same volume and substantially the same transverse cross-sectional area of another propellant as one another.

18. The downhole stimulation tool of claim 11, wherein at least one of the initiators is adjacent at least one of end of the propellant structure, and at least one other of the initiators is adjacent at least one of end of the another propellant structure.

19. The downhole stimulation tool of claim 11, wherein at least one of the initiators is located between adjacent propellant regions of the propellant structure, and at least one other of the initiators is located between adjacent propellant regions of the another propellant structure.

20. A method of stimulating a producing formation, the method comprising: positioning a downhole stimulation tool within a wellbore intersecting the producing formation, the downhole stimulation tool comprising:

a substantially monolithic outer housing comprising:

two regions free of apertures extending therethrough; and an additional region longitudinally intervening between the at least two regions and exhibiting apertures extending therethrough;

opposing propellant structures substantially longitudinally confined within the at least two regions of the outer housing and each individually comprising:

at least one higher combustion rate propellant region; and at least one lower combustion rate propellant region adjacent the at least one higher combustion rate propellant region; and at least one initiator adjacent each of the opposing propellant structures; and initiating each of the opposing propellant structures to combust the opposing propellant structures and vent produced combustion gases through the apertures in the outer housing to increase pressure adjacent to and within the producing formation, wherein the additional region of the substantially monolithic outer housing is substantially free of propellant structures contained therein prior to the ignition of the opposing propellant structures.

21. The method of claim 20, wherein initiating each of the opposing propellant structures comprises initiating at least one region of each of the opposing propellant structures in sequence with at least one other region of each of the opposing propellant structures.

22. The method of claim 20, wherein initiating each of the opposing propellant structures comprises initiating at least one end of each of the opposing propellant structures.

23. The method of claim 20, wherein initiating each of the opposing propellant structures comprises initiating the opposing propellant structures to produce a pressure profile in excess of hydrostatic wellbore pressure adjacent the producing formation to exhibit a plurality of pressure rises and a plurality of pressure falls over a period of time.

24. The method of claim 23, further comprising producing the pressure profile for a duration of greater than or equal to about one second.

25. The method of claim 23, further comprising producing the pressure profile for a duration of greater than or equal to about sixty seconds.

26. The method of claim 20, further comprising anchoring the downhole stimulation tool into position within the wellbore.

27. The method of claim 20, further comprising physically containing the increased pressure within an interval of the wellbore adjacent the producing formation.

* * * * *